United States Patent [19]

Shinmoto

[11] 4,453,466

[45] Jun. 12, 1984

[54] PAPER DISCHARGE DEVICE FOR OFFSET PRINTING MACHINE

[75] Inventor: Takahiko Shinmoto, Hiroshima, Japan

[73] Assignee: Ryobi Ltd., Hiroshima, Japan

[21] Appl. No.: 497,305

[22] Filed: May 23, 1983

[30] Foreign Application Priority Data

May 27, 1982 [JP] Japan ..... 57-78810[U]

[51] Int. Cl.[3] ..... B41F 13/64

[52] U.S. Cl. ..... 101/240; 271/214; 271/217

[58] Field of Search ..... 101/287, 232–242; 271/214, 217

[56] References Cited

U.S. PATENT DOCUMENTS

| | | | |
|---|---|---|---|
| Re. 13,469 | 10/1912 | Barr | 271/214 X |
| 2,195,545 | 4/1940 | Stobb | 101/240 |
| 2,734,743 | 2/1956 | Spurlino et al. | 271/217 X |
| 3,051,332 | 8/1962 | Richert et al. | 271/214 X |
| 3,162,439 | 12/1964 | Poland et al. | 271/214 X |
| 3,512,479 | 5/1970 | McHenry et al. | 101/232 |

FOREIGN PATENT DOCUMENTS

| | | | |
|---|---|---|---|
| 457535 | 6/1949 | Canada | 271/217 |
| 290015 | 5/1928 | United Kingdom | 271/217 |

*Primary Examiner*—E. H. Eickholt

*Attorney, Agent, or Firm*—Sughrue, Mion, Zinn, Macpeak & Seas

[57] ABSTRACT

A paper discharge device for an offset printing machine includes a table for receiving discharged paper, the table being lowered in conjunction with the height of the paper stack thereon. The table is driven by means of a ratchet mechanism which is engaged only when paper is actually output from the printing machine, so that the table is not excessively lowered when the printing machine is driven but does not output printed paper.

7 Claims, 2 Drawing Figures

PAPER DISCHARGE DEVICE FOR OFFSET PRINTING MACHINE

BACKGROUND OF THE INVENTION

The present invention relates to a paper discharging means for an offset printing machine.

In general, there is provided a means for discharging papers which removes printed papers from a rubber cylinder by means of a gripper, and draws them out onto a table which is arranged, for example, at the back of a printing machine. This device facilitates the after treatment of the printed papers in the offset printing machine.

In this discharging device, the table is provided in such a way as to fittedly engage a pair of rails which are longitudinally provided so as to be opposite to the insides of frames on either side of the printing machine proper, or frames on both sides of the device are fixedly mounted to the above-mentioned frames so as to be capable of being raised and lowered. The table is arranged so as to be lowered in its proper course by a drive chain which is provided around a sprocket of a sprocket shaft provided so as to be moved in conjunction with the driving of the printing machine.

However, the conventional discharge means is constructed such that the ratchet coupled to the sprocket shaft is always in engagement with the feed pawl which feeds the ratchet, so that the table is lowered without regard to whether papers are discharged or not.

Therefore, since the printing machine proper is driven in case the supply of paper is brought to a halt for some reason, the table continues to be lowered. Therefore, when printing is started again, the drop of the discharged paper to the table becomes longer than required. Hence, there is an inconvenience in that the direction and the like of the papers does not become uniform, thereby worsening the proper arrangement thereof.

In addition, a troublesome manual operation was required to return the table upwardly to correct for the excessive lowering in the midst of printing.

SUMMARY OF THE INVENTION

As a result of studies in view of the above-mentioned state of affairs in accordance with the prior art, the present invention provides a means for discharging papers, an object of which is to make it possible for the portion from a gripper to the surface on which the papers are discharged to be kept at a desired height, so as to improve the proper arrangement of the papers when the same are discharged. The troublesome operation of adjusting the height of the table in the midst of printing is omitted by constructing the apparatus in such a way that the table is lowered when the papers are discharged and is not lowered when papers are not discharged. Table movement is provided in conjunction with the operation of inserting the cylinder in the printing machine.

DETAILED DESCRIPTION OF THE PREFERRED EMBODIMENTS

Figure 1:
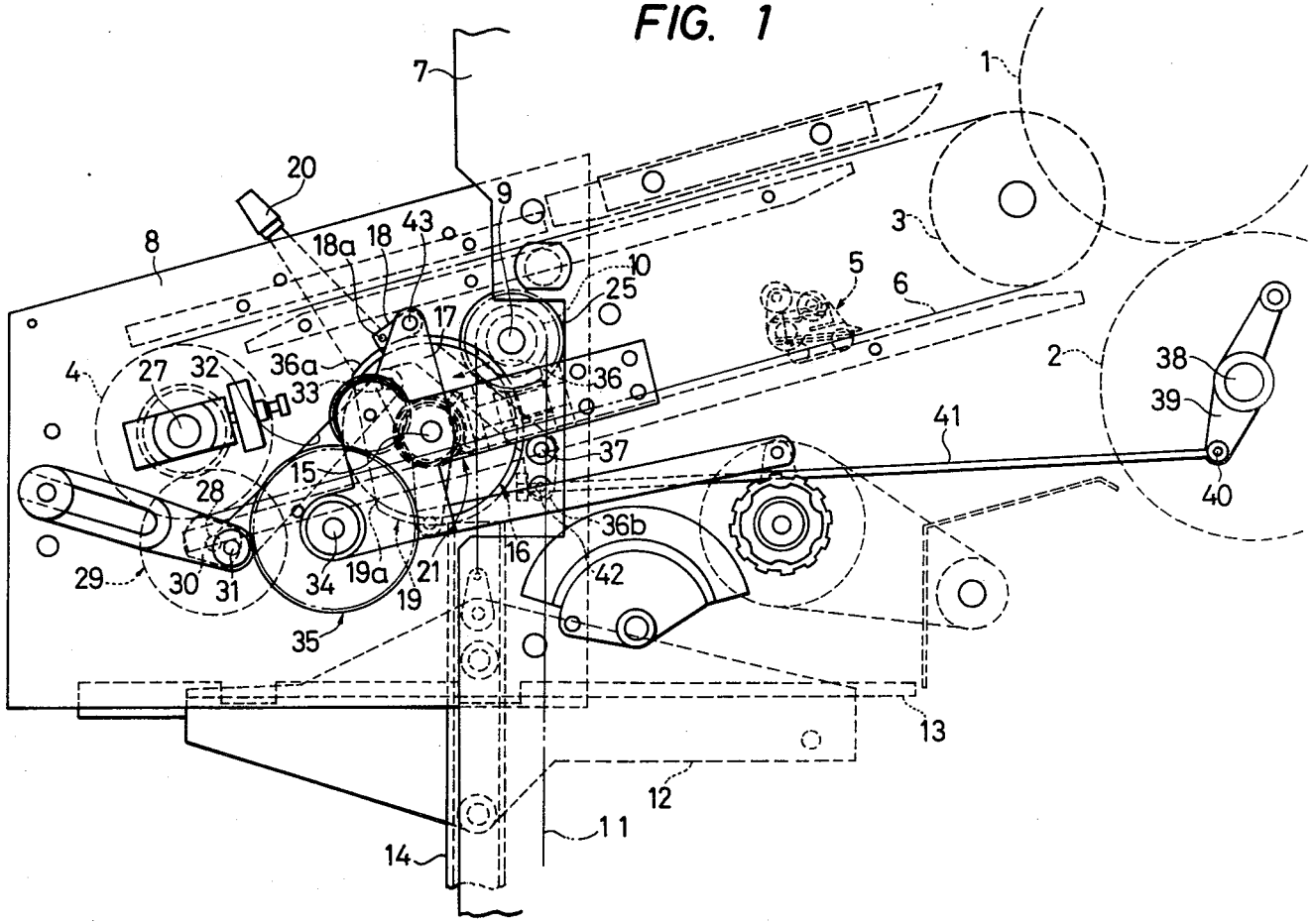
FIG. 1 is a side view showing the discharge device of an offset printing machine in accordance with the present invention.

An explanation will now be given in detail in respect of an embodiment shown in the accompanying drawings. There is provided a drive chain 6 which is provided with a gripper 5. Sprockets 3, 4 are respectively supported by their shafts at the rear of a rubber cylinder 1 and an impression cylinder 2 of an offset printing machine, as shown in FIG. 1. A paper (not shown in the drawing) is printed by means of the rubber cylinder 1 and the impression cylinder 2 and is carried rearwardly, that is, to the left in the drawing, and is released at a predetermined position, whereby the paper is discharged.

Figure 2:
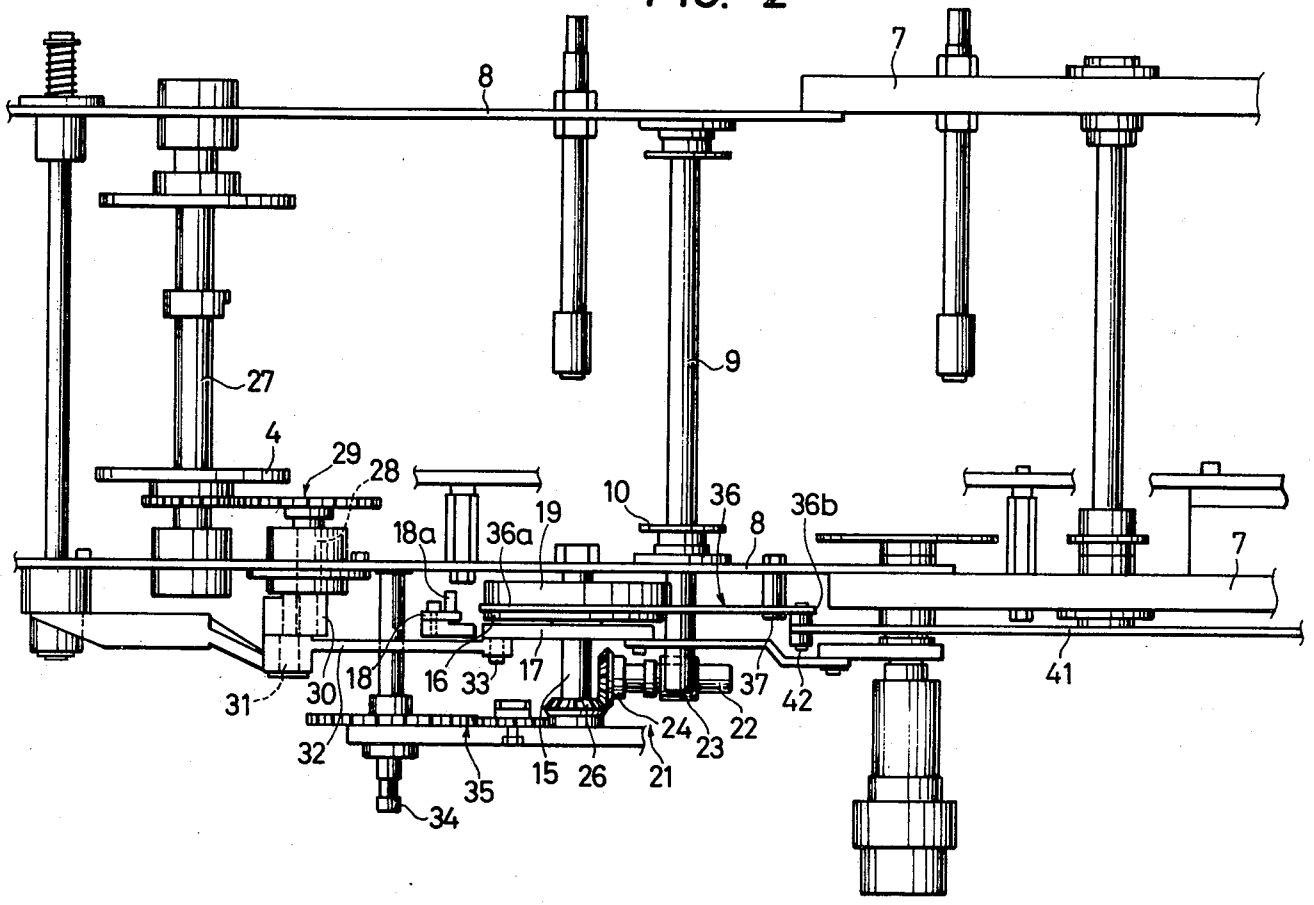
FIG. 2 is a partially unfolded plan view showing the device of FIG. 1.

The paper discharging device in accordance with the present invention is constituted as follows. As shown in FIGS. 1 and 2, a sprocket shaft 9 is rotatably provided on a pair of frames 8, 8 of the discharging means, which frames are fixedly mounted to a pair of frames 7, 7 of the printing machine proper. A table 13 for discharged papers is detachably placed on a pair of brakcets 12, 12 connected to ends of a pair of drive chains 11, 11 provided on a pair of sprockets 10, 10 of the sprocket shaft 9. By rotation of the sprocket shaft 9, the brackets 12, 12 are guided so as to fittingly engage a pair of rails 14, 14 which are longitudinally provided at the insides of the pair of frames 8, 8, thereby making it possible for the table 13 to be raised and lowered.

In addition, a rotary shaft 15 is rotatably supported by the pair of frames 8, 8 in parallel with the sprocket shaft 9. A ratchet 16 is fixedly mounted on the rotary shaft 15, and there are rotatably and idly fitted thereon a cam 19 as well as a lever 17 to which a feed pawl 18 is pivotably mounted by means of a pin 43 at one end thereof. The feed pawl 18 is in engagement with the ratchet 16 so as to be able to disengage therefrom. The cam 19 is formed like a disk having a diameter somewhat larger than the ratchet 16, and there is formed a cut portion **19*a* at one side thereof. If the cam is arbitrarily rotated by means of an operation lever 20, it is possible to vary the position of the cut portion 19*a* at will with respect to the position at which the feed pawl 18 engages the ratchet 16. It is possible for the feeding amount of the ratchet 16 by the feed pawl 18 to be arbitrarily adjusted also by means of the lever 17**, which is moved through a predetermined angle as described hereafter.

In addition, the rotary shaft 15 is coupled to the sprocket shaft 9 by means of a power transmission mechanism 21 such as a gear transmission mechanism or the like.

That is, an intermediate shaft 22 is arranged so as to be supported by the frame 8 perpendicularly to the sprocket shaft 9 and the rotary shaft 5, and a worm gear 23 and a bevel gear 24 are respectively fixedly mounted on the intermediate shaft 22 and are respectively in engagement with a worm wheel 25 and a bevel gear 26 fixedly mounted on the sprocket shaft 9 and the rotary shaft 15 respectively. Thus, the rotational power of the rotary shaft 15 is transmitted to the sprocket shaft 9 via the bevel gears 26, 24, the intermediate shaft 22, the worm gear 23 and the worm wheel 25.

The above-mentioned lever 17 is coupled to a drive mechanism of the printing machine proper, so as to be swung through a predetermined angle upon starting of the printing machine, without regard to the insertion of the cylinder or the supply of the paper.

In accordance with the example shown in the drawings, the drive means of the lever 17 is provided such that a rotary shaft 27 fixedly mounts a sprocket 4, which engages a shaft 28 supported by the frame 8 by means of a gear mechanism 29. An eccentric pin 31 is embedded in a block 30 mounted on the shaft 28. One end of a link 32 is pivotably fixed by means of the pin 31 and the other end is pivotably fixed by means of a pin 33 to lever 17. If the rotary shaft 27 is rotated in one direction by starting the printing machine, the link 32 is reciprocated by the eccentricity of the eccentric pin 31, so that the lever 17 reciprocates through a predetermined angle. A weight is connected as a balancer (not shown) at the other end of the drive chain 11.

A stud shaft 34 is rotatably provided on the frame 8. The shaft 34 is coupled to the rotary shaft 15 via gear transmission mechanism 35. If the stud shaft 34 is rotated by means of a handle (not shown) detachably mounted thereon, the sprocket shaft 9 is rotated, thereby making it possible for the table 13 to be raised and lowered by this manual operation.

Furthermore, an operational arm 36 for the feed pawl 18 is pivotably provided on the frame 8 by means of a stud shaft 37, and one end **36*a* thereof is formed substantially like an arc and arranged so as to come into contact with the lower portion of a pin 18*a* projected from the feed pawl 18. The other end 36*b* of the arm 36 is pivotably fixed by means of a pin 42 to one end of a link 41. The other end of link 41 is pivotably fixed by means by a pin 40 to one end of an arm 39 fixedly supported by a shaft 38 of the rubber cylinder. The arm 39 is coupled to a cylinder insertion means (not shown) so as to be actuated in conjunction with the operation of inserting or removing the impression cylinder 2**.

In other words, the cylinder insertion means detects that paper is supplied and inserts the cylinder. In conjunction therewith, the arm 39 is rotated anticlockwise in FIG. 1, so that the link 41 is moved to the right. As a result, the arm 36 for actuating the feed pawl is rotated anticlockwise, so that the end **36*a* thereof is lowered to release the upward force on the feed pawl 18, so as to engage the ratchet 16. If the cylinder is removed, the arm 36 actuating the feed pawl is rotated clockwise, so that the feed pawl 18 is pushed up, thereby releasing the engagement with the ratchet 16**.

Although the example shown in the drawing is for the case where there is provided a machine effecting printing on one surface and provided with a printing cylinder, a rubber cylinder 1 and an impression cylinder 2, the discharging means in accordance with the present invention can also be applied to a perfecting printing machine composed of two printing cylinders and two rubber cylinders. In this case, the arm for actuating the feed pawl is coupled to a means for the insertion of a second rubber cylinder, which works also as an impression cylinder with respect to the first rubber cylinder.

In accordance with the discharging means of the present invention, a feed pawl 18 engages and disengages the ratchet 16 by means of an arm 36 to actuate the feed pawl in conjunction with the operation of inserting and removing the cylinder in the printing machine. A lever 17 is reciprocated in conjunction with the driving of the printing machine and the ratchet 16 is intermittently rotated by a desired feeding quantity by means of the feed pawl 18, thereby moving the drive chain 11 so that the table 13 for discharged papers is lowered, the table 13 being lowered only when the cylinder is inserted and printed papers are being discharged. Table 13 is not lowered when the cylinder is pulled out and printing is interrupted or brought to a halt, such that paper is not being discharged in spite of the fact that the printing machine is driven. Therefore, since the table 13 is lowered by the desired feeding quantity in conjunction with the discharging of paper by setting the feeding quantity in advance by means of the cam 19 in accordance with the printing speed, the thickness of the paper and the like, it is possible for the table to begin to be lowered from the same height (position) as that when printing was interrupted, even if the printing machine continued to be driven. Hence, it is possible for the drop of the papers to be kept at a set value, making it possible for the papers to be discharged in order at a predetermined position on the table 13, so as to improve the proper arrangement of the papers. In addition, since the troublesome operation of adjusting the table to the desired height after printing is interrupted, as in accordance with the prior art, is not required, the operational efficiency at the time of printing is enhanced.

What is claimed is:

1. A paper discharge device for a printing machine, comprising: a ratchet fixedly provided on a rotary ratchet shaft, said shaft being rotatably supported on a frame in a manner such as to be rotatably coupled to a sprocket shaft; said sprocket shaft raising and lowering a table for discharged papers; a pivotable feed pawl for engaging said ratchet; a lever adapted to be reciprocated in conjunction with the driving of said printing machine; an arm for actuating said feed pawl such that said feed pawl engages and disengages said ratchet, said arm being coupled to cylinder insertion means of said printing machine, whereby said feed pawl engages and disengages said ratchet in conjunction with the operation of setting a cylinder to operative and inoperative positions.

2. A device as claimed in claim 1, further including gear transmission means between said ratchet shaft and said sprocket shaft.

3. A device as claimed in claim 1, further including lever pivot means supported by said frame and connected to said lever, said pivot means comprising eccentric drive means and an intermediate lever having one end connected to said lever, said lever pivotally supporting said feed pawl at one end thereof.

4. A device as claimed in claim 1, said sprocket shaft including a sprocket in engagement with a driver chain, said chain being connected to said table whereby rotation of said sprocket shaft effects said raising or lowering of said table.

5. A device as claimed in claim 2, said gear transmission means comprising a bevel gear pair and worm gear means.

6. A device of claim 1 wherein said feed pawl has one end provided with a pin, and said arm is pivotally supported to said frame by a stud shaft, said arm having one end positioned below said pin and the other end provided with a connecting pin.

7. A device of claim 6 further including arm pivot means, said arm pivot means comprising a rod and a pivot arm rotatally supported by a rubber cylinder, said rod extending between said connecting pin and a tip end of said pivot arm, whereby operation of said rubber cylinder operates said arm.

* * * * *